US007479938B2

(12) United States Patent
May

(10) Patent No.: US 7,479,938 B2
(45) Date of Patent: Jan. 20, 2009

(54) OPTICALLY ADDRESSABLE DISPLAY AND METHOD DRIVEN BY POLARIZED EMISSIONS

(75) Inventor: Gregory J May, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 850 days.

(21) Appl. No.: 10/665,831

(22) Filed: Sep. 19, 2003

(65) Prior Publication Data

US 2005/0062682 A1 Mar. 24, 2005

(51) Int. Cl.
*G09G 3/30* (2006.01)
*G09G 3/32* (2006.01)
*G09G 3/36* (2006.01)

(52) U.S. Cl. ..... 345/81; 345/76; 345/82; 345/83; 345/207

(58) Field of Classification Search ..... 345/30, 345/84, 32, 76–83, 207; 348/743; 359/443, 359/448
See application file for complete search history.

(56) References Cited

U.S. PATENT DOCUMENTS 5,289,171 A * 2/1994 Nire et al. ..... 345/76
5,517,340 A * 5/1996 Doany et al. ..... 349/5
5,612,798 A * 3/1997 Tuli ..... 349/24
5,706,061 A * 1/1998 Marshall et al. ..... 348/743
5,831,601 A * 11/1998 Vogeley et al. ..... 345/175
6,227,669 B1 * 5/2001 Tiao et al. ..... 353/31
6,356,251 B1 * 3/2002 Naito et al. ..... 345/81
6,404,137 B1 * 6/2002 Shodo ..... 315/169.1
6,453,067 B1 * 9/2002 Morgan et al. ..... 382/162
6,603,504 B1 * 8/2003 Son et al. ..... 348/54
6,680,579 B2 * 1/2004 Allen et al. ..... 315/169.3
6,707,516 B1 * 3/2004 Johnson et al. ..... 349/78
6,819,064 B2 * 11/2004 Nakanishi ..... 315/408
7,061,480 B2 * 6/2006 Anderson et al. ..... 345/207
7,277,090 B2 * 10/2007 Allen et al. ..... 345/204
2003/0184862 A1 * 10/2003 Sahouani et al. ..... 359/490
2004/0008159 A1 * 1/2004 Cunha et al. ..... 345/30
2004/0085271 A1 * 5/2004 Koll et al. ..... 345/82
2005/0041163 A1 * 2/2005 Butler-Smith et al. ..... 348/744
2005/0104806 A1 * 5/2005 Stephenson, III ..... 345/50
2005/0122291 A1 * 6/2005 May ..... 345/83

FOREIGN PATENT DOCUMENTS

GB 2118803 A * 11/1983

OTHER PUBLICATIONS

Jianmin Chen, Michael G. Robinson and Gary Sharp, "40.4 Two-Panel Architecture for Reflective LCD Projector", SID 01 Digest, p. 1084-1087.

* cited by examiner

*Primary Examiner*—Sumati Lefkowitz
*Assistant Examiner*—Seokyun Moon

(57) ABSTRACT

An optically addressable display of a preferred embodiment uses emissions having plural polarizations to define a corresponding number of color channels. A data encoder applies data for each of the color channels to corresponding ones of the plural polarizations. The display also includes plurality of pixels for producing a color display. There is a plurality of receptors including at least one receptor for each pixel. The receptors activate pixels depending upon which, if any, of the plural polarizations is received.

36 Claims, 10 Drawing Sheets

OPTICALLY ADDRESSABLE DISPLAY AND METHOD DRIVEN BY POLARIZED EMISSIONS

FIELD OF THE INVENTION

The invention is in the optically addressed display field. The invention is applicable to a wide range of devices using displays including, for example, home entertainment monitors and large outdoor stadium displays.

BACKGROUND OF THE INVENTION

Optical display technology continues to evolve competitively. Displays are being developed that are larger, thinner, and yield higher resolutions. Optically addressable displays ("OAD") allow for larger display sizes while maintaining a minimal amount of circuitry. The circuitry is kept at a minimum because the OAD's pixel elements, which usually contain LEDs activated by receptors, are responsive to light and not electronic signals. The complicated wiring of each pixel that allows it to be activated is eliminated.

The current techniques used to deliver color information to OADs have various drawbacks such as alignment and cost. One technique commonly used is an infrared raster addressing scheme. Each pixel element's color receptor is located and addressed with an IR beam. However, because each receptor is responsive to the IR beam, alignment becomes an issue. The IR beam needs to be precisely aligned to ensure that only the appropriate receptor is addressed at the right time. If the IR beam is misaligned with the color receptors the entire display could shift to an incorrect color set. Additionally, a less severe misalignment could cause the image on the display to exhibit a color shift.

Another technique for delivering color information is frequency modulation. The frequency of the IR beam is varied at the IR source and projected onto the receptor circuits of the pixel elements. The receptor circuits are responsive to one of the varied frequencies of the IR beam. The corresponding pixel is activated only when the receptor receives its varied frequency. Alignment is less of a problem with this technique because each color circuit would be activated only when the correct frequency of the IR beam is received by the receptor. However, this technique is costly and complicated. Every color circuit would have different components resulting in increased costs. The frequency modulation hardware would also increase the cost and complexity on the projector end.

Utilizing different wavelengths of light for each color is also another technique used for delivering color information. A red, green, and blue pixel each includes a receptor that is unique from the other two colored pixels. A different wavelength of light is projected onto the receptors for each of the multiple colors. The receptors contain narrow optical filters that allow the unique selection of the color channels. As with the frequency modulation technique alignment is less of a problem, however, these optical wavelength filters can be very expensive. There remains a need for a cost-efficient optically addressable display system that overcomes the alignment issue.

SUMMARY OF THE INVENTION

An optically addressable display of a preferred embodiment uses emissions having plural polarizations to define a corresponding number of color channels. A data encoder applies data for each of the color channels to corresponding ones of the plural polarizations. The display also includes a plurality of pixels for producing a color display. There is a plurality of receptors including at least one receptor for each pixel. The receptors activate pixels depending upon which, if any, of the plural polarizations is received.

DETAILED DESCRIPTION OF THE INVENTION

The present invention is directed to optically addressable displays and methods for delivering color information to optically addressable displays. In the invention, polarized visible or non-visible emissions define multiple color channels. In an exemplary embodiment, sequentially polarized emissions produce multiple color channels where data is delivered sequentially for separate channels. In another embodiment, polarized emissions define multiple color channels simultaneously. Data is added to the polarized emissions by a data encoder. Preferably, the polarized emissions encompass the entire data encoder. In preferred embodiments, the data encoder is realized with an array of digital light processing mirrors. Depending on the applied data, the data encoder's elements selectively reflect the emissions onto corresponding pixels. In preferred embodiments, a multi-color pixel corresponds to each mirror. With the polarization phase encoding, the corresponding mirror encodes the multiple colors of the pixel.

The invention will now be illustrated with respect to exemplary embodiment devices. Methods of the invention will also be apparent from the following discussion. In describing the invention, particular exemplary devices will be used for purposes of illustration. Illustrated devices may be schematically presented, and exaggerated for purposes of illustration and understanding of the invention.

Figure 1:
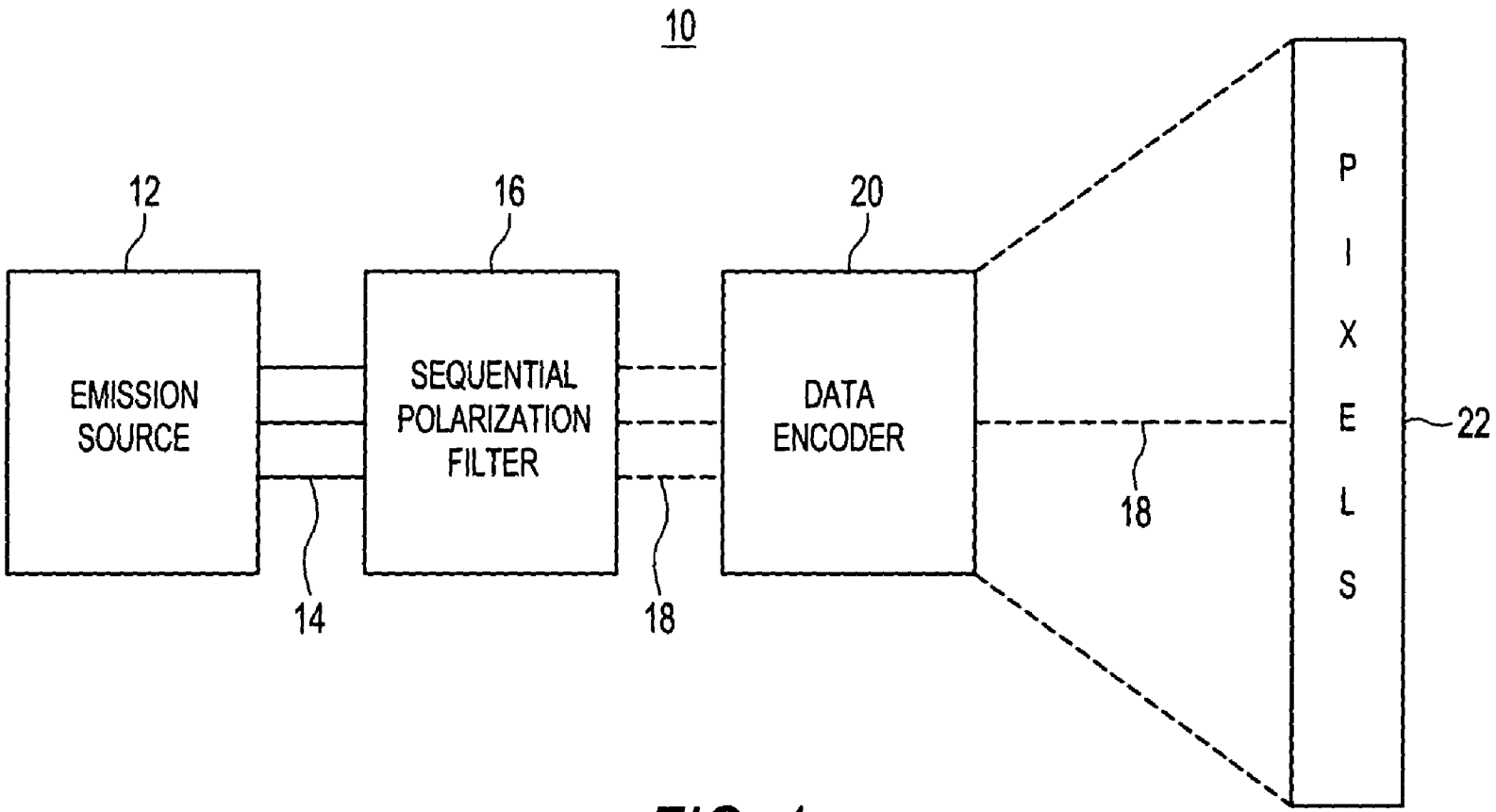
FIG. 1 is a block diagram illustrating a preferred embodiment of an optically addressable display system.

In FIG. 1, an exemplary optically addressable display 10 includes an emission source 12 that generates emissions 14. A polarization filter 16 is disposed in the path of the emissions 14 to sequentially polarize the emissions into sequentially polarized emissions 18. Sequential polarization, as used herein, means that the polarization changes over time, providing the opportunity to define multiple channel encoding over a period of time. A linear polarization over a 360° rotation is preferred as a straightforward implementation, while polarization may also be changed sequentially to particular polarization phases that are maintained for a period of time. The latter polarization filter is a more complicated approach to realize in practice.

The polarization filter might be realized optically, by lensing, for example. However, other methods of polarization are also possible, including sequential and simultaneous methods. The simultaneous methods permit polarization to encode multiple color channels and the data for the multiple color channels is sent at the same time. For example, liquid crystals can perform a polarization function and do not require sequential timing in addressing the display. Another possibility is the omission of a filter in favor of an emission source that changes polarization, or multiple sources that have different polarizations. In some embodiments, there are multiple emission sources for each pixel. For example, the emission source 12 may also be comprised of multiple sources, each providing a distinct polarized emissions. As an additional example, there might be an emission source having a distinct polarization only for each color channel. Sequential or simultaneous polarization might then be utilized.

Considering again the FIG. 1 embodiment, a data encoder 20 applies data to the sequentially polarized emissions 18 on a pixel-by-pixel basis. In embodiments of the invention a pixel 22 is a multi-color pixel, and the data encoder applies data to each pixel through the sequentially polarized emissions 18. Pixel, as used herein, refers to the resolution of the encoder 20. For example, in the case of a digital mirror device, each mirror defines the resolution of a pixel. Physically, that pixel may comprise any number of physical elements that can respond to a polarized emission and produce a display. In large or projected display systems, a mirror might address three, four or another number of colored LEDs, for example. In addition, the mirror might also be addressing groups of colored LEDs, e.g., 50 red LEDs, 50 green LEDs and 50, blue LEDs. Here, and in other places, the number of colors and the number of physical elements is provided only by way of example. Color science and management may change from implementation to implementation, but the polarization encoding of the invention may still be applied, as artisans will appreciate.

Whether or not a pixel is activated is determined by the data encoder, while the color activated for each multi-color pixel depends upon the state of the polarized emissions 18. The data encoder 20 therefore combines with the polarization filter 16 to present data including an on/off state, intensity and color to each pixel 22. Intensity is controlled, for example, by the encoder controlling a duration for activating a pixel during a particular polarization phase. As an example, the red portion of a multi-color pixel may be made active for half of the corresponding red encoding polarization phase. This produces a lower intensity than if the red portion is held active for three quarters of a corresponding red encoding polarization phase. In addition, the data could encode timing. As an example, using the end of a polarization phase to illuminate a particular color in a pixel can produce a mixing effect as the physical element producing the particular color has a decay that will overlap the display of a physical element producing a different color during a different polarization phase.

The emission source 12 preferably generates non-visible emissions to avoid interfering with the display by pixels 22. Infrared (IR) emissions are suitable. However, an emission source 12 that generates visible spectrum emissions, such as a laser, may be used effectively, as well.

Figure 2A:
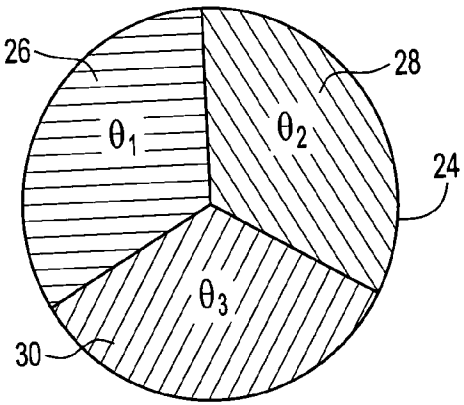
FIGS. 2A-2D are schematic views of an exemplary circular multi-segment polarization filter.
Figure 2B:
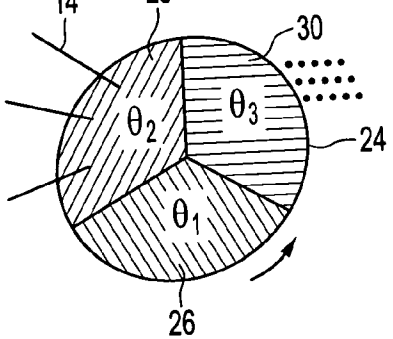
Figure 2C:
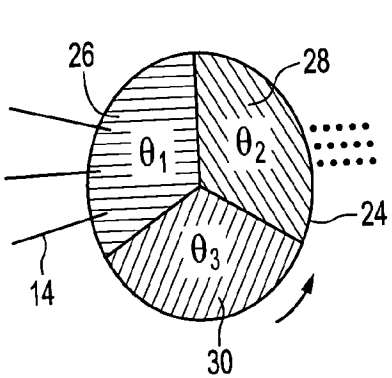
Figure 2D:
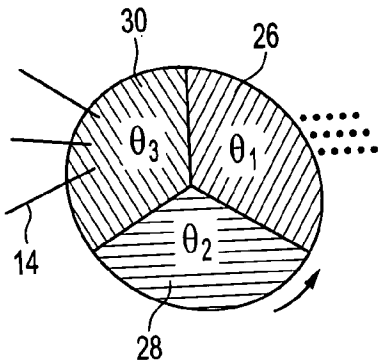

An exemplary embodiment of the polarization filter 16 is a spinning circular multi-segment filter 28 as shown in FIGS. 2A-2D. The multi-segment filter 24 contains multiple segments 26, 28, and 30. The multiple segments are polarized to respective phases $\theta_1$, $\theta_2$, and $\theta_3$. Exemplary phases $\theta_1$, $\theta_2$, and $\theta_3$ are 0 degrees, 120 degrees, and 240 degrees, but it is understood that the embodiment is not restricted to these specific phases. Each of these phases corresponds to a color data channel. For example, 0 degrees may correspond to red, 120 degrees to green, and 240 degrees to blue. The multi-segment filter 24 rotates, as illustrated by FIGS. 2B-2D. The rotation causes the emissions 14 to become sequentially polarized as they pass through the multi-segment polarized filter 24. The data encoder 20 is synchronized to the sequentially polarized phases so that it can encode the proper colors at the proper polarization phases. However, the synchronization may be electronically altered. This could, for example, be used to compensate for physical effects that alter the polarization.

One complete rotation cycle of the multi-segment filter 24 brings each segment 26, 28, and 30 of the multi-segment filter 24 into the pathway of the emissions 14. When a segment such as 26, encounters the emissions 14, the emissions 14 become polarized with respect to the phase $\theta_1$ of segment 26, as shown in FIG. 2B. The multi-segment filter 24 continues to rotate bringing segment 28 into the pathway of the emissions 14. The emissions 14 become polarized with respect to phase $\theta_2$ of segment 28 as it passes through segment 28, as shown in FIG. 2C. The final segment 30 will encounter the pathway of the emissions 14 as the multi-segment filter 24 completes one rotation. As the emissions 14 pass through segment 30, the emissions 14 become polarized with respect to $\theta_3$ of segment 30, as shown in FIG. 2D. Continued rotation allows for the emissions 14 to be polarized in a sequence of phases resulting in the sequentially polarized emissions 18.

Figure 3A:
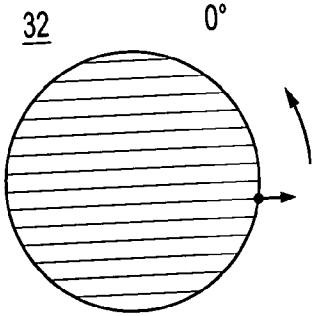
FIGS. 3A-3F are schematic views of an exemplary circular linear filter polarization filter.
Figure 3B:
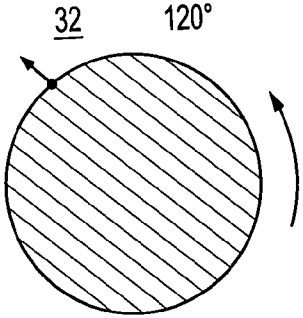
Figure 3C:
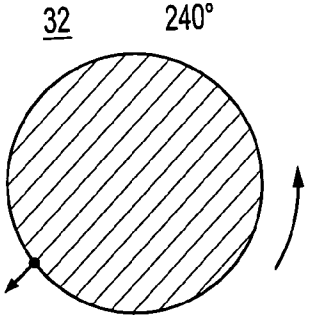

Alternatively, the polarization filter 16 may also be a circular linear filter 32, as shown in FIGS. 3A-3F. Although the linear filter 32 is not comprised of discrete segments like the multi-segment filter 24, sequentially polarized emissions 18 are still produced. As the linear filter 32 rotates, the polarization phase changes continuously as shown in FIGS. 3A-3F. As the emissions 14 pass through the rotating linear filter 32, sequentially polarized emissions 18 are produced. The rotation of the linear filter 32 produces phase peaks, for example, at 0 degrees, 120 degrees, and 240 degrees. The point of rotation as shown in FIG. 3A will cause the emissions 14 to become polarized with respect to $\theta$ which is, for example, a peak of 0 degrees. As the linear filter 32 rotates in a counter-clockwise direction $\theta$ changes as shown in FIG. 3B and the emissions 14 will become polarized with respect to a peak of 120 degrees. The polarization angle $\theta$ continues to change as shown in FIG. 3C and the emissions 14 are polarized with respect to a peak of 240 degrees at this rotation point. As an example, the sequentially polarized emissions 18 can be assigned with respect to bands near the peaks of 0 degrees, 120 degrees, and 240 degrees for the color data channels for red, green, and blue, respectively. These channels may also be respectively assigned bands around the corresponding peaks that are 180 degrees out of phase, namely peaks at 180 degrees, 300 degrees, and 60 degrees.

Figure 4:
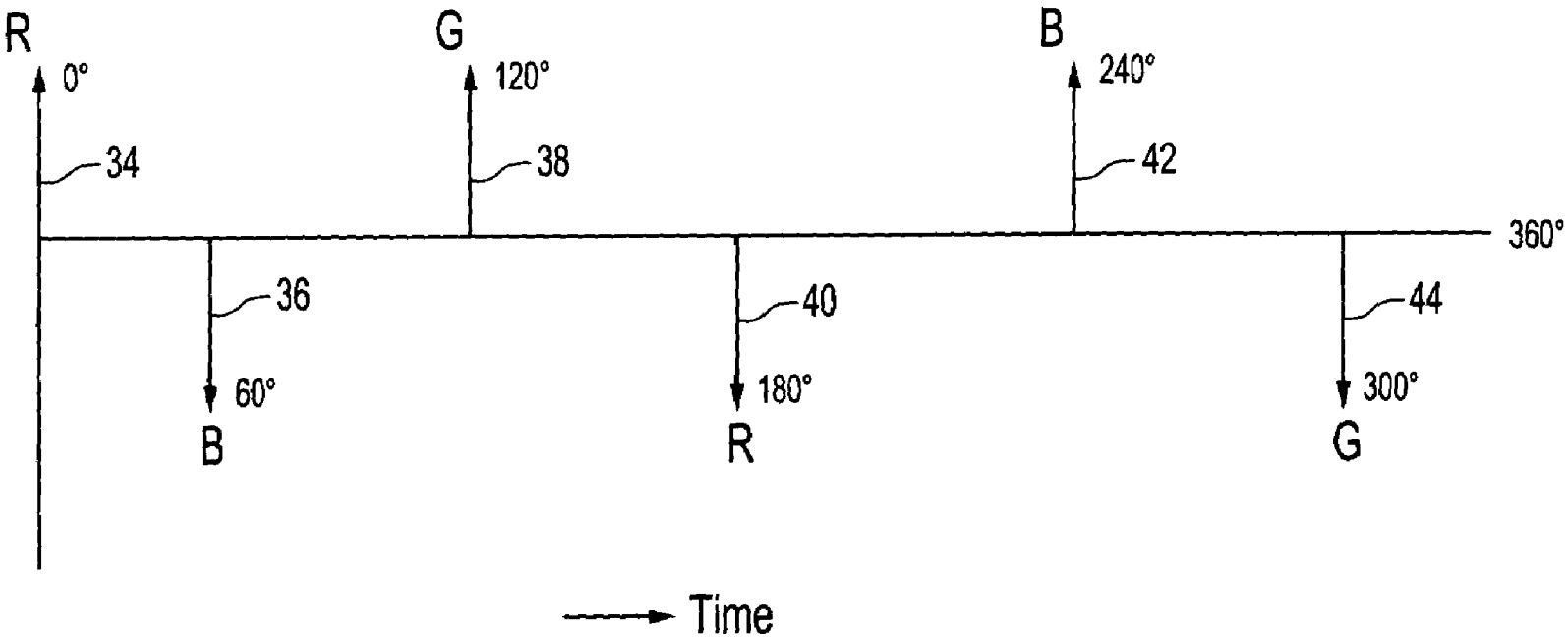
FIG. 4 is a graph illustrating an exemplary polarization phase sequence of an emission.

Referring now to FIG. 4, the phase peaks that correspond to the color data channels (R)ed, (G)reen, and (B)lue are shown. The polarized emissions 18 polarized with respect to the 0 degree (34) and 180 degree (40) peaks of the linear filter 32 correspond to the red color data channel. The polarized emissions 18 polarized with respect to the 60 degrees (36) and 240 degree (42) peaks of the linear filter 32 correspond to the blue color data channel. The polarized emissions 18 polarized with respect to the 120 degree (38) and 300 degree (44) peaks of the linear filter 32 correspond to the green color data channel.

It is understood that the present invention is not limited to these specific associations of the color data channels with these specific phases.

Figure 3D:
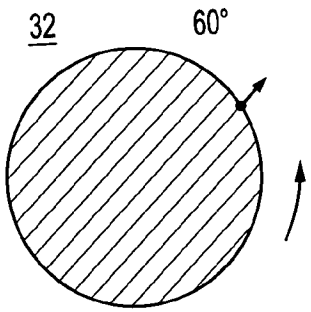
Figure 3E:
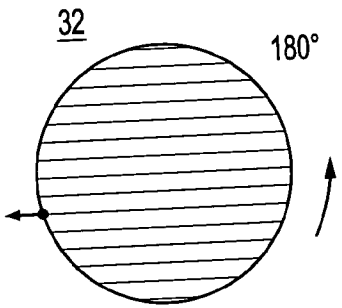
Figure 3F:
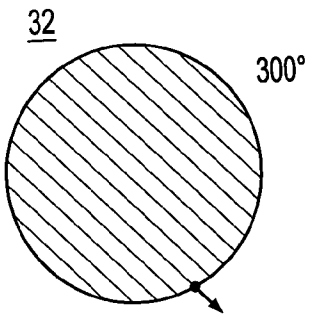

Referring back to FIGS. 3A-3F, the sequential polarization of the emissions 14 will be described. As the linear filter 32 begins to start a counterclockwise rotation cycle, the emissions 14 are polarized with respect to the red color data channel at the 0 degree peak, as shown in FIG. 3A. The emissions 14 are polarized with respect to the blue color data channel at the 60 degree peak as the linear filter 32 completes ⅙ of the rotation cycle, as shown by FIG. 3D. The emissions 14 are polarized with respect to the green color data channel at the 120 degree peak as ⅓ of the rotation cycle is completed, as shown by FIG. 3B. When the linear filter 32 rotates halfway through one cycle, the emissions 14 become polarized with respect to the red color data channel again at the 180 degree peak, as shown by FIG. 3E. At ⅔ of a rotation, the emissions 14 are polarized with respect to the blue color data channel again at the 240 degree peak, as shown by FIG. 3C. The emissions 14 are polarized with respect to the green color data channel again at the 300 degree peak upon completion of ⅚ of one rotation cycle, as shown by FIG. 3F. The 300 degree peak completes the sequential polarization of one rotation cycle of the linear filter 32. Similar cycles are produced by a clockwise rotation.

Figure 5A:
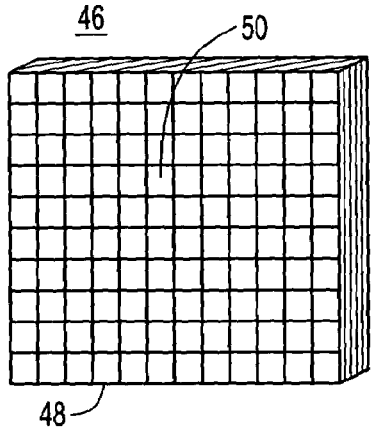
FIGS. 5A-5C are schematic views of an exemplary data encoder.
Figure 5B:
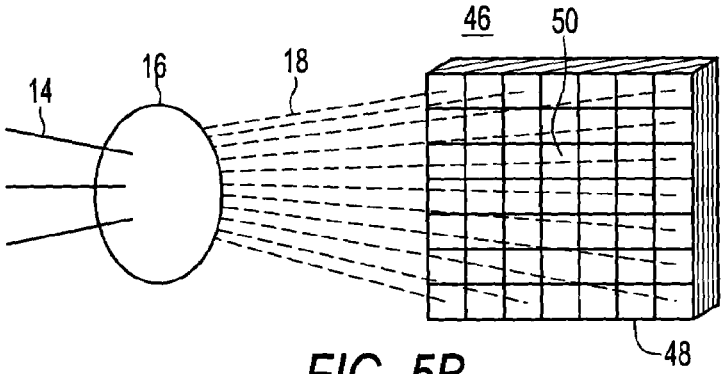

FIG. 5A illustrates a preferred embodiment of the data encoder 20, which is a digital micro-mirror device ("DMD") 46, such as those available from Texas Instruments. More generally, a DMD 46 contains an array 48 of mirrors 50 that correspond to the plurality of pixels 22. In a preferred embodiment, each mirror 50 corresponds to a single pixel 22. The array 48 of mirrors 50 is preferably completely encompassed by the sequentially polarized emissions 18, as shown in FIG. 5B. A raster scan is also possible, but having the sequential emissions 18 encompass the DMD 46 eliminates the potential for misalignment problems between the source 12 and DMD 46. Each mirror 50 is capable of moving independently of the others. The independent movement allows the mirrors to selectively reflect a portion of the sequentially polarized emissions 18 to its corresponding pixel. In certain embodiments, a mirror 50 is controlled to be turned away or toward a corresponding multi-color pixel for each of multiple separate polarization phases, depending on applied data. For a particular color display, a pixel requires a corresponding mirror 50 to be toward it and a corresponding state of the sequentially polarized emissions.

An on state is defined by a mirror 50 directing sequentially polarized emissions 18 to a corresponding pixel 22. An off state is defined by the mirror 50 reflecting sequentially polarized emissions 18 away from a pixel, and preferably to a light absorber 52 (FIG. 5C) if the emissions are in the visible range. The mirrors 50 may also be dithered to control intensity and timed to produce color mixing effects owing to the decay cycle of physical elements, e.g., LEDs used for color display in the pixels 22.

Figure 5C:
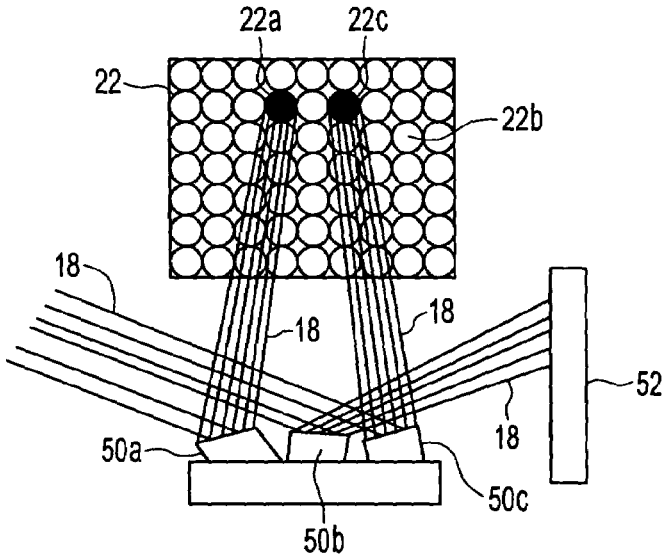

FIG. 5C shows the mirrors 50 in their on and off states. For illustration purposes, FIG. 5C shows three mirrors 50*a*, 50*b*, and 50*c*. The sequentially polarized emissions 18 in this illustration correspond to the red color data channel. Sequentially polarized emissions 18 encompass all of the mirrors 50*a*, 50*b*, and 50*c*. With data applied, pixels 22*a* and 22*c* are red as a result of the mirrors 50*a* and 50*c* directing polarized emissions corresponding to the red channel toward pixels 22*a* and 22*c*. Mirror 50*b* corresponds to a pixel 22*b* which is to display no red during the current duration of the red color channel according to data applied to mirror 50*b*.

The array 48 of mirrors 50 is timed with the phases of the polarization filter so that red data is applied during the red color channel, for example. This timing may be altered to produce display effects or to perform compensations.

Figure 6A:
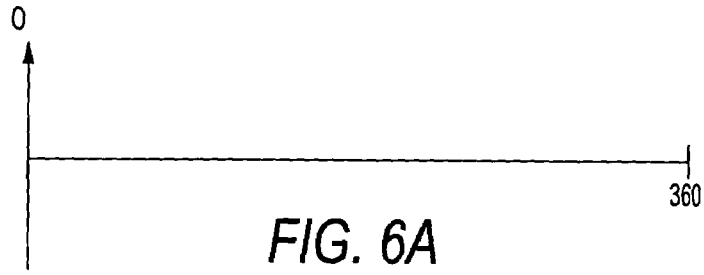
FIGS. 6A-6E are graphs illustrating an exemplary timing scheme of the data encoder and polarization filter of FIG. 1.
Figure 6B:
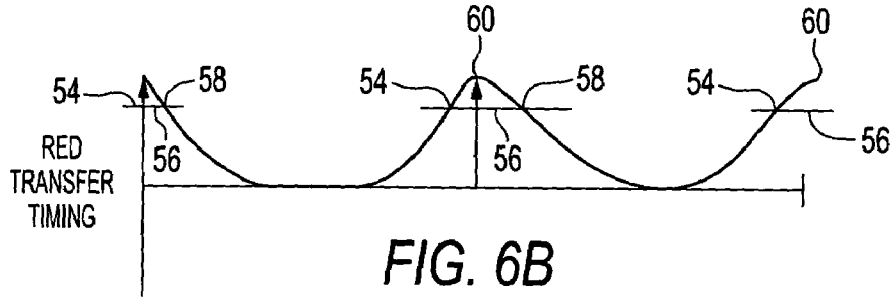
Figure 6C:
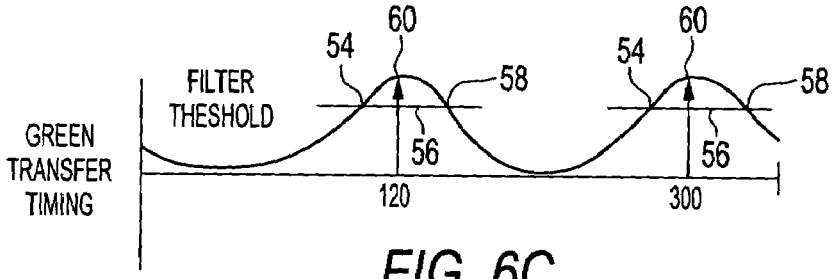
Figure 6D:
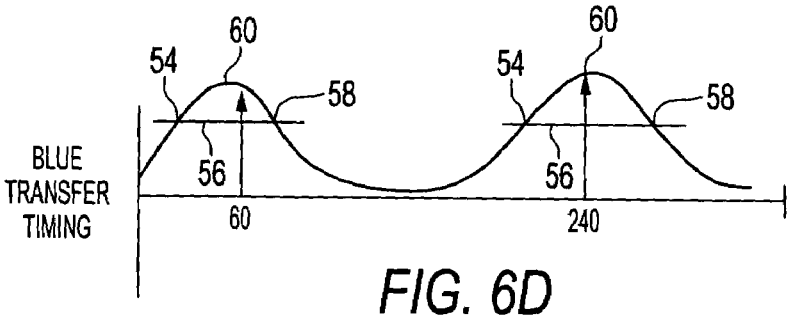
Figure 6E:
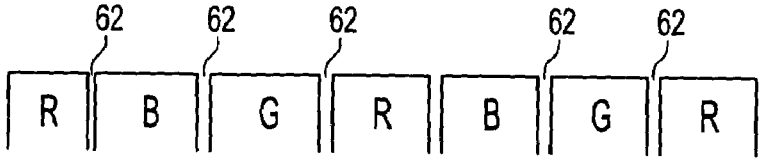

FIGS. 6A-6E illustrate a preferred timing scheme of mirrors 50 for embodiments of the invention where using a linear polarization filter and sequential polarization. FIG. 6A represents the filter before it starts to spin. FIGS. 6B-6E illustrate the timing of the mirrors 50 and the emissions for the red, green, and blue color data channels. Channels begin at points 54 and end after a period of time. Specifically, filter thresholds 56 create bands defined between points 54 and 58 around emission peaks 60 that occur at different phases. For example, a red color channel is available in a band of emissions that result from a filter threshold 56, near and including the 0 and 180 degree peaks. Referring now to FIG. 6E, when one peak of the polarization phase has ended there is preferably a gap of time 62 before the next color data channel is encoded. The gap 62 will prevent overlap in addressing two colors simultaneously.

Figure 7:
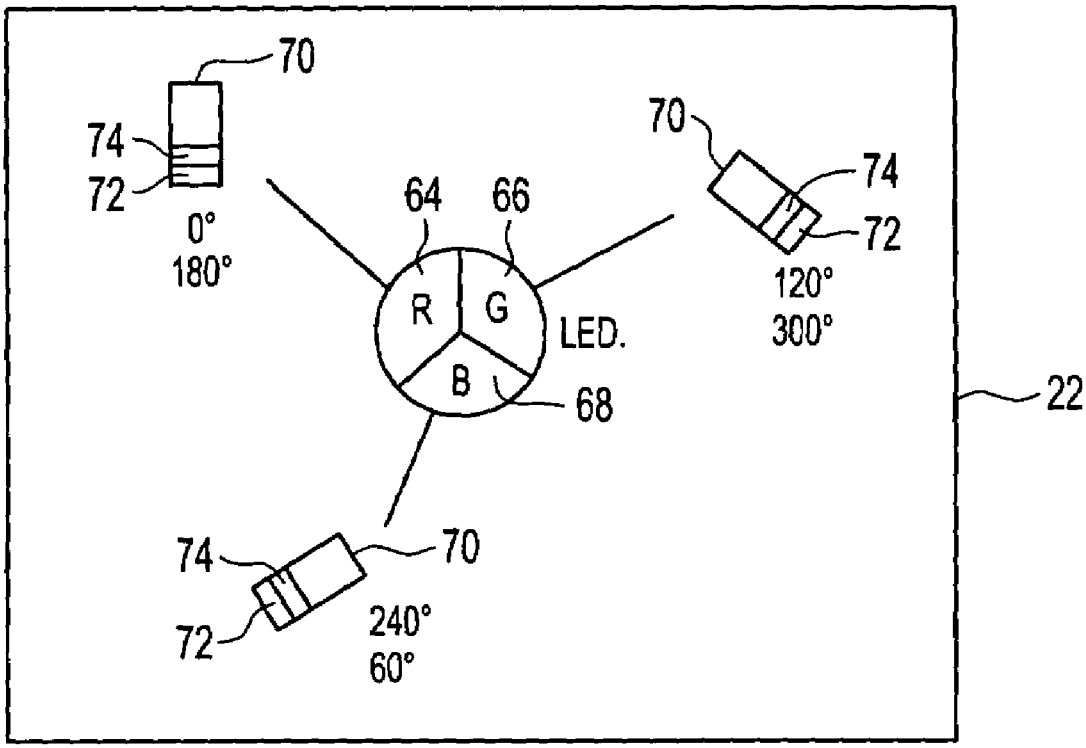
FIG. 7 is a conceptual physical layout of an exemplary multi-color pixel.

Referring now to FIG. 7, an exemplary pixel 22 includes a red 64, a green 66, and a blue 68 light emitting diode ("LED") and corresponding receptors 70. Each receptor 70 includes a polarization filter 72 that is disposed over the receiving end 74 of the receptor 70. Receptors 70 of red pixels are responsive to a corresponding polarization state, receptors of green pixels to another, and receptors of blue to another. Different polarization filters may be used for this purpose, or, as in FIG. 7, the orientation of a filter 72 may determine its response. Through the latter technique, a single type of rotationally sensitive filter 72 may be used for multiple colors. In a large, mass manufactured device, this can reduce part count and provide significant cost savings. For example, the receptor 70 for the red LED 64 is positioned so that emissions polarized with respect to 0 or 180 degree bands are the only emissions that will pass through the polarized filter 72 on the receiving end 74 of the receptor. In this way, a multi-color pixel may be addressed by a single mirror 50.

Figure 8:
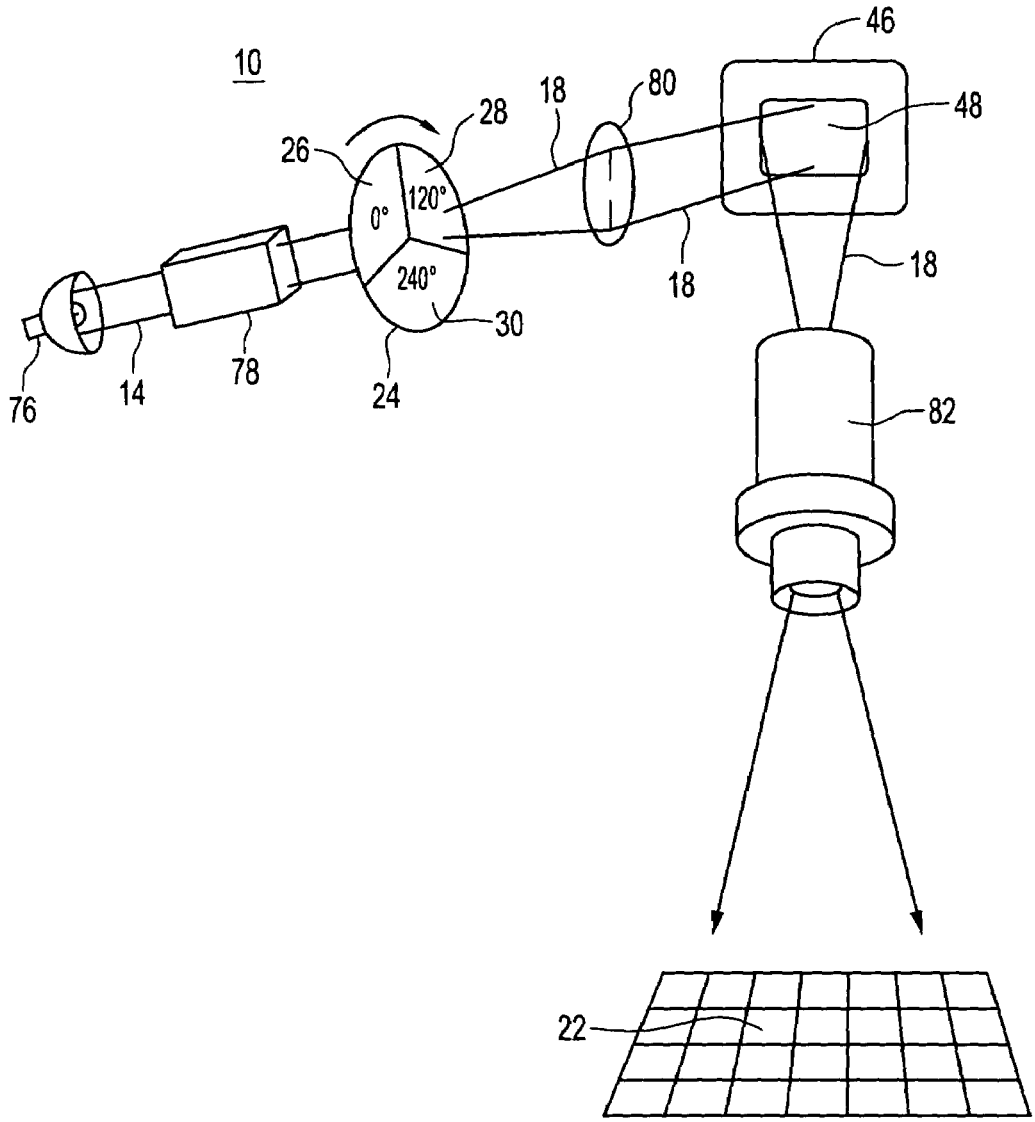
FIG. 8 is a schematic diagram illustrating an exemplary optically addressable display device.

Referring now to FIG. 8, a method of delivering color information to an optically addressable display will be described with respect to a preferred embodiment display. An infrared source 76 generates emissions 14 in the non-visible spectrum. The emissions 14 pass through the rotating multi-segment polarization filter 24. The segments 26, 28, and 30 of the filter 24 polarize emissions 14 to 0, 120, and 240 degrees, respectively. As the multi-segment filter 24 rotates in a counter-clockwise direction, the emissions 14 are sequentially polarized. The sequentially polarized emissions 18 are made uniform by an integrating rod 78, which might be placed prior to the filter 24 to avoid an altering of the polarization. A condensing lens 80 may be used to ensure coverage of the DMD 46. The emissions 18 encompass the array 48 of mirrors 50 on the DMD 46. The mirrors 50 are phase coordinated with the segments 26, 28, and 30. If segment 26 codes the red color channel, the DMD 46 activates only those mirrors 50 have red data during that cycle. A projection lens 82 focuses sequentially polarized emissions 18 directed by the mirrors 50 toward receptors of pixels 22.

Figure 9:
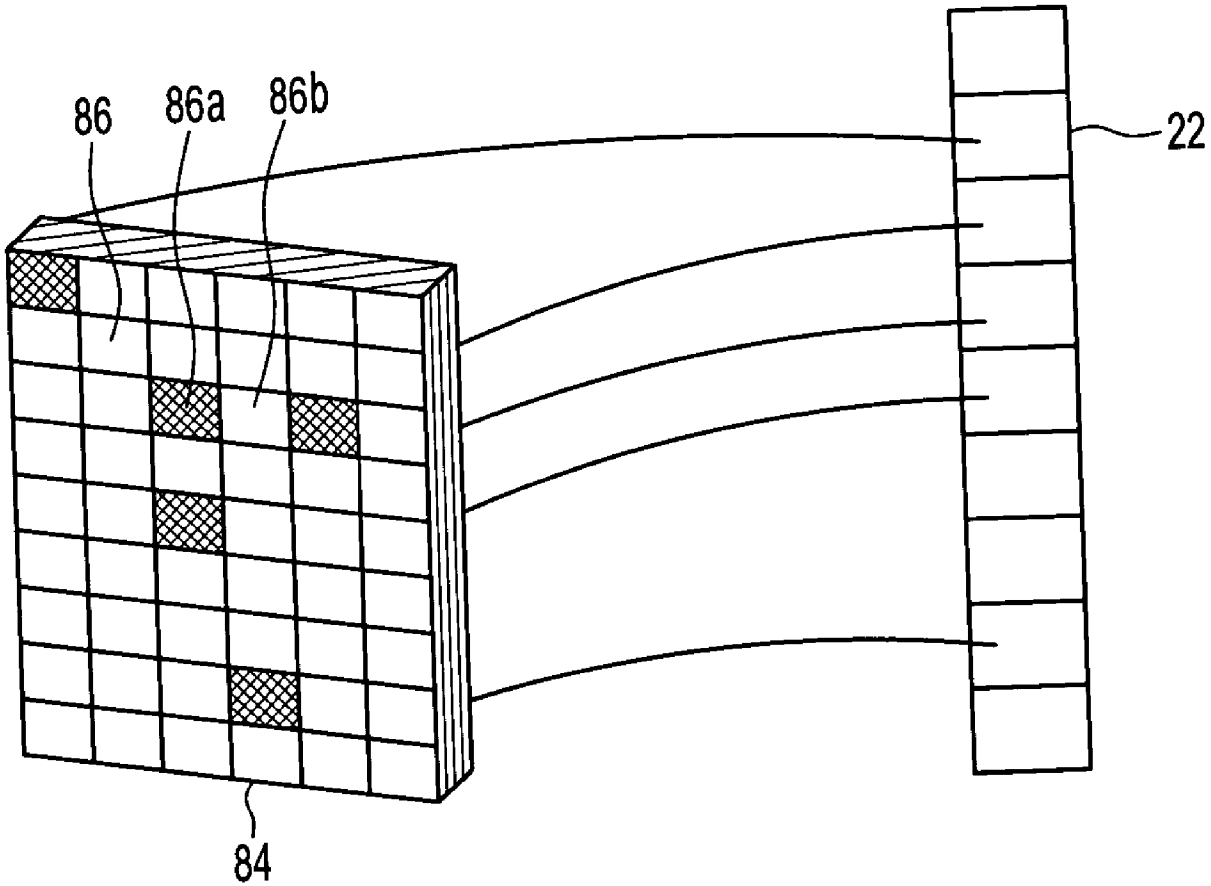
FIG. 9 illustrates another exemplary embodiment data encoder.

In an alternative embodiment, as illustrated by FIG. 9, the data encoder 20 is an array of light masks 84, such as an LCD array. Each of the light masks 86 corresponds to one or more of the individual pixels 22. The light masks 86 may be phase matched with the sequentially polarized emissions 18, similar to the DMD as described above. A sequentially polarized emission 18 encompasses the entire array of light masks 84, and only the light masks 86*a* that have red data during that cycle will permit the polarized emissions 18 to pass.

Figure 10A:
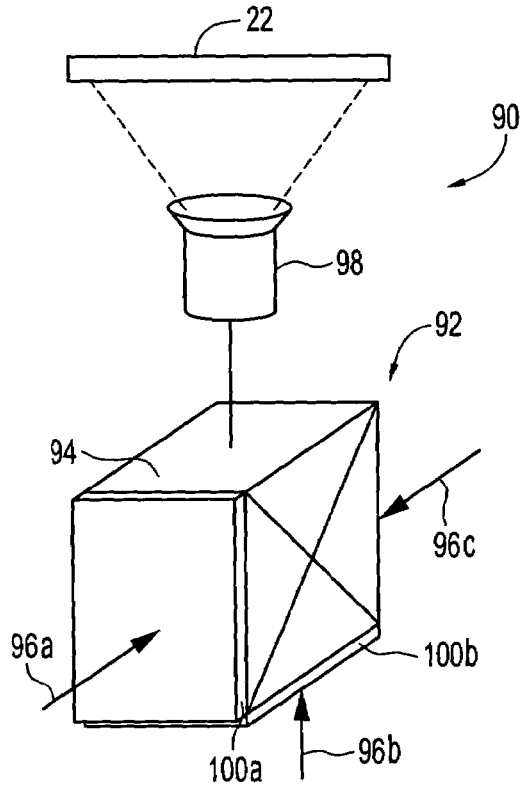
FIGS. 10A-10C illustrate another exemplary embodiment optically addressable display device.
Figure 10B:
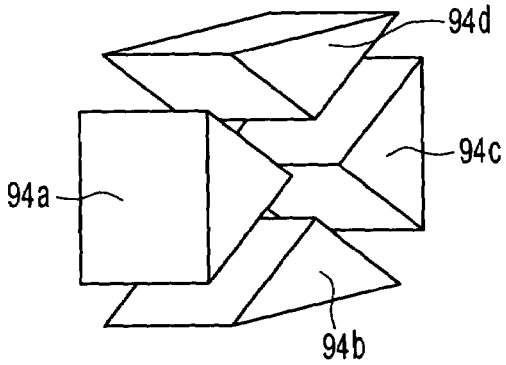
Figure 10C:
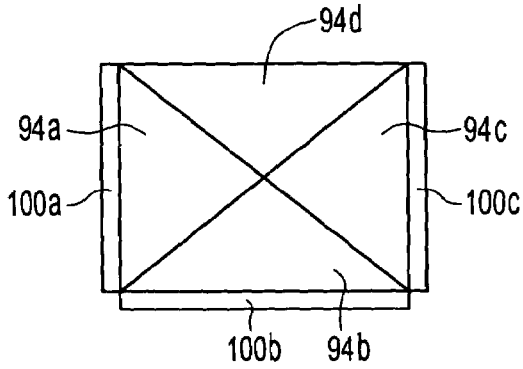

Another optically addressed display device 90 is illustrated in FIGS. 10A-10C. In FIG. 10A, the display 90 includes an array of pixels 22 as in the other embodiments. The pixels 22, for example, are constructed as described with respect to FIG. 7. A data encoder 92 in the device 90 is an LCD shutter crystal 94. The LCD shutter crystal 94 receives three different beams 96*a*, 96*b* 96*c* having distinct polarizations. Tri-color data is applied to the LCD shutter crystal 94, which responds by selectively blocking or passing one or all of the three different beams 96*a*, 96*b*, and 96*c* for each of the pixels 22 in the array of pixels. In this manner, color data can be simultaneously delivered to each of the pixels 22, but the resolution of the LCD shutter crystal need not be higher than that of the pixels 22. A projecting lens 98 delivers data from an output side of the shutter crystal 94 to the pixel array. The shutter crystal 94 includes four prisms 94l, 94*b*, 94*c*, and 94*d*. LCD shutters 100*a*, 100*b*, and 100*c* are applied to respective input faces of the prisms 94*a*, 94*b*, 94*c*. The prism 94*d* serves to output encoded data emissions. Each of LCD shutters 100*a*, 100*b*, and 100*c* encodes emissions having a different polarization and corresponding to a different color channel. The shutters have a resolution of the pixels 22. In this way, a pixel may receive data for the three color channels simultaneously as the data encoder encodes each set of polarized emissions separately and then combines the data encoded emissions to be directed at the pixels 22.

While specific embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

The invention claimed is:

1. An optically addressable display comprising:

a projection device including, a mechanism to create emissions having plural polarizations, wherein the number of polarizations defines a corresponding number of color channels; and a data encoder to apply data for each of the color channels to the emissions having corresponding ones of the plural polarizations; and a screen including, a plurality of pixels for producing a color display; and a plurality of receptors including at least one receptor for each of said plurality of pixels responsive to a corresponding polarization state for each of the color channels, said plurality of receptors activating said pixels using a corresponding color channel depending upon which, if any, of the emissions having a corresponding polarization state for said corresponding color channel is received.

2. The display according to claim 1, wherein said data encoder receives said emissions having plural polarizations simultaneously and applies data simultaneously for each of the multiple color channels.

3. The display according to claim 1, wherein the mechanism to create emissions further comprises:

a source producing visible or non-visible spectrum emission; and a polarization filter to sequentially polarize said visible or non-visible emissions to produce said emissions; wherein said data encoder sequentially applies data for the multiple color channels on a channel-by-channel basis to the sequentially polarized emissions.

4. The display according to claim 3, wherein said polarization filter is a multi-segment filter, each segment corresponding to a different one of multiple polarization phases.

5. The display according to claim 4, wherein said multi-segment filter comprises a rotating filter disposed in the path of said emissions to sequentially polarize said emissions through the segments of the multi-segment filter having the multiple polarization phases.

6. The display according to claim 3, wherein said polarization filter is a rotating linear filter that sequentially polarizes said emissions through multiple polarization phase peaks.

7. The display according to claim 6, wherein each pixel comprises a multi-physical element pixel for displaying multiple colors, and wherein different ones of said multiple colors are encoded within bands near different ones of said multiple polarization phase peaks.

8. The display according to claim 3, wherein said polarization filter comprises a circular polarization filter.

9. The display according to claim 3, wherein said data encoder comprises an array of light masks each corresponding to one or more of said receptors, each of said light masks selectively blocking or permitting said emissions to pass to a corresponding one or more of said receptors based upon the data.

10. The display according to claim 3, wherein said data encoder comprises an array of digital light processing mirrors, each corresponding to one or more of said receptors, each of said digital light processing mirrors selectively reflecting said emissions away from or toward a corresponding one or more of said receptors based upon the data.

11. The display according to claim 10, wherein said sequentially polarized emissions comprises a single beam of emissions having a diameter that completely encompasses said array of digital light processing mirrors.

12. The display according to claim 11, comprising a separate mirror for each of said pixels and a corresponding one of said receptors.

13. The display according to claim 12, wherein each pixel has one of multiple colors;

said polarization filter sequentially polarizes said emissions into one of multiple polarization states, a separate polarization state corresponding to each of the multiple colors; and each receptor is responsive to only one of said multiple separate polarization states.

14. The display according to claim 13, wherein, each of said digital light processing mirrors is positioned to reflect light away from its corresponding receptor in response to a data indicating that its corresponding pixel should be off.

15. The display according to claim 14, wherein said polarization filter is a rotating linear filter that sequentially polarizes said emissions through multiple polarization phase peaks.

16. The display according to claim 15, wherein each of said receptors is responsive to the emissions polarized with respect to bands near different ones of said multiple polarization phase peaks.

17. The display according to claim 15, further comprising a light absorber to absorb light reflected away from said receptors.

18. The display according to claim 13, further comprising an integrating rod to provide uniformity to the emissions produced by said source.

19. The display according to claim 3, further comprising a projecting lens after said data encoder to project said sequentially polarized emissions toward said plurality of receptors.

20. The display according to claim 1, each of said plurality of pixels including multiple corresponding receptors, each of said multiples corresponding receptors responding to a different polarization state of said emissions having plural polarizations, each of said plurality of pixels producing one of multiple colors as a display.

21. The display according to claim 1, wherein each of said plurality of pixels comprises a plurality of light emitting diodes.

22. The display according to claim 21, wherein each of said pixels includes light emitting diodes of at least three different colors.

23. The display according to claim 1, wherein said data encoder comprises an LCD shutter device.

24. The display according to claim 23, wherein said LCD shutter device receives said emissions having plural polarizations simultaneously and applies data simultaneously for all of the color channels on a pixel-by-pixel basis.

25. A method of encoding color data to activate an optically addressable display including a plurality of pixels, the method comprising the steps of:

at a projection device:

producing emissions having different polarizations;

for each pixel, applying data to each of said emissions having different polarizations by selectively passing said emissions having different polarizations to said pixels;

at the optically addressable display:

at each pixel, responding to each of said emissions having different polarizations with a corresponding receptor; and producing a different display for each of said emissions having different polarizations when responded to by the corresponding receptor.

26. The method of encoding according to claim 25, wherein said step of producing comprises:

generating an emission in a visible or non-visible spectrum; and alternating a polarization of said emission.

27. The method of encoding according to claim 26, wherein said generating step comprises generating a laser emission.

28. The method of encoding according to claim 26, wherein said alternating step comprises filtering said emission.

29. The method of encoding according to claim 26, wherein said alternating step comprises filtering said emission through one of a multi-segment and linear filter.

30. The method of encoding according to claim 29, wherein said alternating step comprises alternating the polarization between one of multiple different phases.

31. A method of encoding color data to activate an optically addressable display including a plurality of pixels, the method comprising the steps of:

at a projection device:

producing emissions having different polarizations;

for each pixel, applying data to each of said emissions having different polarizations by selectively passing said emissions having different polarizations to said pixels;

at the optically addressable display: responding to each of said emissions having different polarizations;

at each pixel, producing a different display for each of said emissions having different polarizations when received wherein said step of applying data comprises selectively shuttering said emissions having different polarizations.

32. A method of encoding color data to activate an optically addressable display including a plurality of pixels, the method comprising the steps of:

at a projection device:

producing emissions having different polarizations;

for each pixel, applying data to each of said emissions having different polarizations by selectively passing said emissions having different polarizations to said pixels;

at the optically addressable display: responding to ech of said emissions having different polarizations;

at each pixel, producing a different display for each of said emissions having different polarizations when received wherein said step of applying data comprises selectively reflecting said emissions having different polarizations toward or away from a corresponding pixel.

33. A method of encoding color data to activate an optically addressable display including a plurality of pixels, the method comprising the steps of:

at a projection device:

producing emissions having different polarizations;

for each pixel, applying data to each of said emissions having different polarizations by selectively passing said emissions having different polarizations to said pixels;

at the optically addressable display: responding to each of said emissions different polarizations; p2 at each pixel, producing a different display for each of said emissions having different polarizations when received wherein said step of applying data applies data to the emissions having different polarizations simultaneously.

34. The method of encoding according to claim 25, wherein said step of applying data applies data to the emissions having different polarizations sequentially.

35. A method of encoding color data to activate an optically addressable display, the method comprising the steps of:

at a projection device:

defining multiple color channels with emissions having different polarizations; and applying data, on a pixel-by-pixel and channel-by-channel basis to said emissions by permitting emissions to reach a pixel in the optically addressable display indicated to be on by the data; and at the optically addressed display: responding to each of said emission having different polarizations;

filtering to make each set of commonly colored display elements responsive to a different polarization state than other sets of commonly colored display elements.

36. An optically addressable display comprising:

a projection device including, means for directing emissions having plural polarization states toward an array of pixels; and means for selectively passing emissions of each of the plural polarization states according to applied data; and a screen, including, at each pixel, receptor means responsive to each of the plural polarization states; and means for actively producing plural color displays, on for each of the plural polarization states.

* * * * *

UNITED STATES PATENT AND TRADEMARK OFFICE

CERTIFICATE OF CORRECTION

PATENT NO. : 7,479,938 B2
APPLICATION NO. : 10/665831
DATED : January 20, 2009
INVENTOR(S) : Gregory J May It is certified that error appears in the above-identified patent and that said Letters Patent is hereby corrected as shown below:

In column 7, line 16, delete “941” and insert -- 94a --, therefor.

In column 7, line 64, in Claim 3, after “emissions” delete “;” and insert -- having plural polarizations as sequentially polarized emissions; --, therefor.

In column 8, line 47, in Claim 14, after “wherein” delete “,”.

In column 9, line 3, in Claim 20, delete “multiples” and insert -- multiple --, therefor.

In column 10, line 10, in Claim 32, delete “ech” and insert -- each --, therefor.

In column 10, line 29, in Claim 33, after “emissions” insert -- having --.

In column 10, line 29, in Claim 33, before “at” delete “p2”.

In column 10, line 41, in Claim 35, delete “different polarizations” and insert -- multiple polarization states --, therefor.

In column 10, line 47, in Claim 35, delete “emission” and insert -- emissions --, therefor.

In column 10, line 64, in Claim 36, delete “on” and insert -- one --, therefor.

Signed and Sealed this

Twenty-sixth Day of May, 2009

JOHN DOLL
*Acting Director of the United States Patent and Trademark Office*